United States Patent [19]

Doinaga et al.

[11] Patent Number: 4,793,312

[45] Date of Patent: Dec. 27, 1988

[54] FUEL SUPPLY CONTROL ARRANGEMENT FOR AN INTERNAL COMBUSTION ENGINE

[75] Inventors: Hajime Doinaga; Shunji Inoue, both of Hiroshima; Kazunori Matsumoto; Michiya Masuhara, both of Higashihiroshima, all of Japan

[73] Assignee: Mazda Motor Corporation, Hiroshima, Japan

[21] Appl. No.: 43,765

[22] Filed: Apr. 29, 1987

[30] Foreign Application Priority Data

Apr. 30, 1986 [JP] Japan ..... 61-100652

[51] Int. Cl.[4] ..... F02D 41/04

[52] U.S. Cl. ..... 123/492; 123/489

[58] Field of Search ..... 123/492, 478, 480, 489, 123/440, 438

[56] References Cited

U.S. PATENT DOCUMENTS

| | | | |
|---|---|---|---|
| 4,143,623 | 3/1979 | Norimatsu et al. | 123/492 |
| 4,357,923 | 11/1982 | Hideg | 123/492 |
| 4,416,237 | 11/1983 | Aoki et al. | 123/492 |
| 4,454,847 | 6/1984 | Isomura et al. | 123/492 |
| 4,488,529 | 12/1984 | Nishida et al. | 123/492 |

FOREIGN PATENT DOCUMENTS

| | | | |
|---|---|---|---|
| 58-8238 | 1/1983 | Japan . | |
| 59-3132 | 1/1984 | Japan . | |
| 59-7017 | 2/1984 | Japan . | |
| 60-162029 | 8/1985 | Japan | 123/489 |

*Primary Examiner*—Andrew M. Dolinar

*Attorney, Agent, or Firm*—Burns, Doane, Swecker & Mathis

[57] ABSTRACT

A fuel supply control arrangement for use in an internal combustion engine, which is so adapted that, in the arrangement to decrease the air/fuel ratio, i.e., to enrich the air/fuel mixture at a specific operating region by increasing the amount of fuel supply, upon transfer into the specific operating region, the fuel is once increased to an amount more than a regular fuel amount for obtaining an air/fuel ratio set in the specific operating region, so as to be restored thereafter to the regular fuel amount, whereby undesirable leaning of the air/fuel mixture at an early stage of transfer into the specific operating state, arising from adhesion of fuel onto an intake passage wall surface can be prevented.

16 Claims, 5 Drawing Sheets

FUEL SUPPLY CONTROL ARRANGEMENT FOR AN INTERNAL COMBUSTION ENGINE

BACKGROUND OF THE INVENTION

The present invention generally relates to an internal combustion engine, and more particularly, to a fuel supply control system in a specific operating region in which an air/fuel ratio of an air/fuel mixture is set to be different from that in the other operating region. The present invention also relates to a fuel supply control system during transfer from the specific operating region in which the air/fuel ratio of air/fuel mixture is set to be different from that in the other operating region, to such other operating region.

Conventionally, there has been widely employed a fuel supply control system arranged, e.g., to control the fuel so as to achieve a high output of the engine by decreasing an air/fuel ratio of the air/fuel mixture, i.e., by enriching the air/fuel mixture and, for example, in Japanese Laid-Open Patent Application Tokkaisho No. 59-3132, there is proposed a fuel supply control system in which a fuel increasing rate is adapted to be proportional to an opening degree of a throttle valve in a specific operating region for a smooth increase of the fuel amount at the high load period.

Incidentally, in an internal combustion engine provided with a fuel supply means for supplying fuel into an intake passage, in the case where fuel increase is started by transfer into a specific operating region, the actual air/fuel ratio is not immediately corrected to an air/fuel ratio to be set at the specific operating region, but arrives at the set air/fuel ratio only after a considerable delay.

The above phenomenon is considered to be attributable to the fact that, even if the fuel amount is increased immediately after transfer into the specific operating region, part of the increased fuel adheres to the wall surface of the intake passage, and until such adhering state reaches a certain state of equilibrium under the specific operating region, the intended amount of fuel is not actually supplied to the combustion chamber.

On the other hand, there is also invited such a problem that, in the case where the operation is transferred from the specific operating region in which the air/fuel mixture is set to be rich, to the other operating region for operation at an air/fuel mixture leaner than that, e.g., to a low load operating region, the fuel adhering to the wall surface of the intake passage in a comparatively large amount up to that time is temporarily brought into the combustion chamber following the transfer so as to enrich the air/fuel mixture conversely, and consequently, the air/fuel mixture is not readily leaned as desired, thus resulting in deterioration of the emission performance and undesirable increase of torque.

SUMMARY OF THE INVENTION

Accordingly, an essential object of the present invention is to provide a fuel supply control arrangement for an internal combustion engine, which is capable of controlling an air/fuel mixture to have an air/fuel ratio to be set at a specific operating region from a time point immediately after transfer into such specific operating region in which the air/fuel mixture should be enriched, i.e., the air/fuel ratio of the air/fuel mixture should be decreased.

Another important object of the present invention is to provide a fuel supply control arrangement of the above described type, which is capable of controlling an air/fuel mixture to have an air/fuel ratio to be set at the other operating region from a time point immediately after transfer from a specific operating region to such other operating region in order to solve problems taking place during transfer from the specific operating region to the other operating region in which the air/fuel ratio to be set is changed over from a rich side to a lean side.

In accomplishing these and other objects, according to one aspect of the present invention, there is provided as shown in a diagram of FIG. 1, a fuel supply control arrangement for use in an internal combustion engine E provided with a fuel supply means A for supplying fuel into an intake passage of the engine, which includes a specific operating region detecting means B for detecting a specific operating region in which an air/fuel ratio of an air/fuel mixture should be decreased, i.e., air/fuel mixture should be enriched as compared with that in the other operating region, a fuel amount correcting means C for correcting an amount of fuel to be supplied by said fuel supply means, and a correction factor setting means D for setting correction factor for the fuel, with the correction factor setting means D being so arranged as to effect the setting in such a manner that, at an initial stage when the transfer to the specific operating region is detected by said specific operating region detecting means, a fuel increasing rate is set to be higher than that which provides an air/fuel ratio at the specific operating region, and thereafter, to be restored to an original fuel increasing rate which provides said air/fuel ratio.

By the arrangement of the present invention as described above, since it is so arranged that at the initial or early stage when the state of operation of the engine has been transferred into the specific operating region, the fuel is supplied in an increased amount at an increasing rate higher than that to be originally set at the specific operating region by taking into account the amount of fuel adhering to the intake passage wall surface, the intended air/fuel ratio may be immediately obtained from the time point when the fuel amount increase is started, and thus, the tendency to the lean air/fuel mixture at the initial stage of transfer can be positively prevented, with a marked improvement in the response for the fuel supply.

According to another aspect of the present invention, the fuel supply control arrangement includes, as shown in the diagram of FIG. 1, a specific operating region detecting means B for detecting a specific operating region in which an air/fuel ratio of an air/fuel mixture should be decreased, i.e., air/fuel mixture should be enriched as compared with that in the other operating region, a fuel amount correcting means C for correcting an amount of fuel to be supplied by said fuel supply means, and a correction factor setting means D for setting correction factor for the fuel, with the correction factor setting means D being so arranged as to set the correction factor in such a manner that at an initial stage when the transfer from the specific operating region to the other operating region is detected by said specific operating region detecting means, the correction factor is set so as to correct the fuel amount to be smaller than a fuel amount which provides the air/fuel ratio set in said other operating region, and thereafter, to cause the fuel amount to be restored to that which provides said air/fuel ratio.

In the above construction of the present invention, owing to the arrangement that upon transfer of the engine operation from the specific operating region to the other operation region, the fuel is supplied in a decreased amount so as to be smaller in amount than the fuel amount which provides the air/fuel ratio to be originally set in said other operating region by taking into account the amount of fuel adhering to the intake passage wall surface, the intended air/fuel ratio may be immediately obtained from the time point when the fuel amount increase is started, and thus, the tendency to the rich air/fuel mixture at the initial stage of transfer can be positively prevented, with a marked improvement in the response for the fuel supply.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
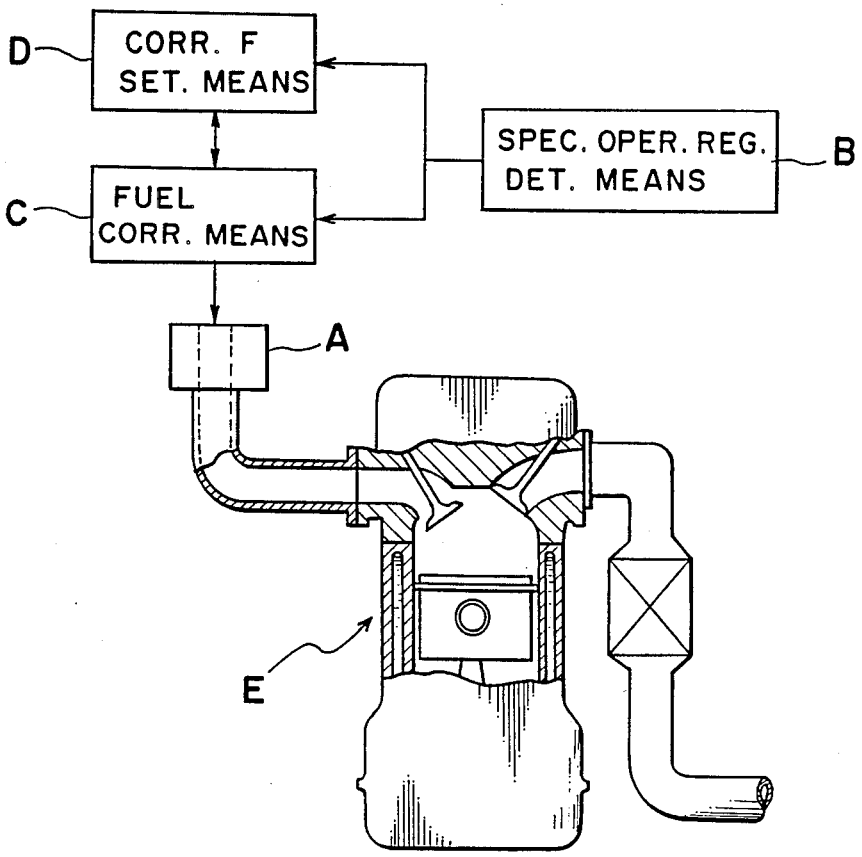
FIG. 1 is a diagram representing a general construction of a fuel supply control system according to the present invention (already referred to)

Before the description of the present invention proceeds, it is to be noted that like parts are designated by like reference numerals throughout the accompanying drawings.

Figure 2:
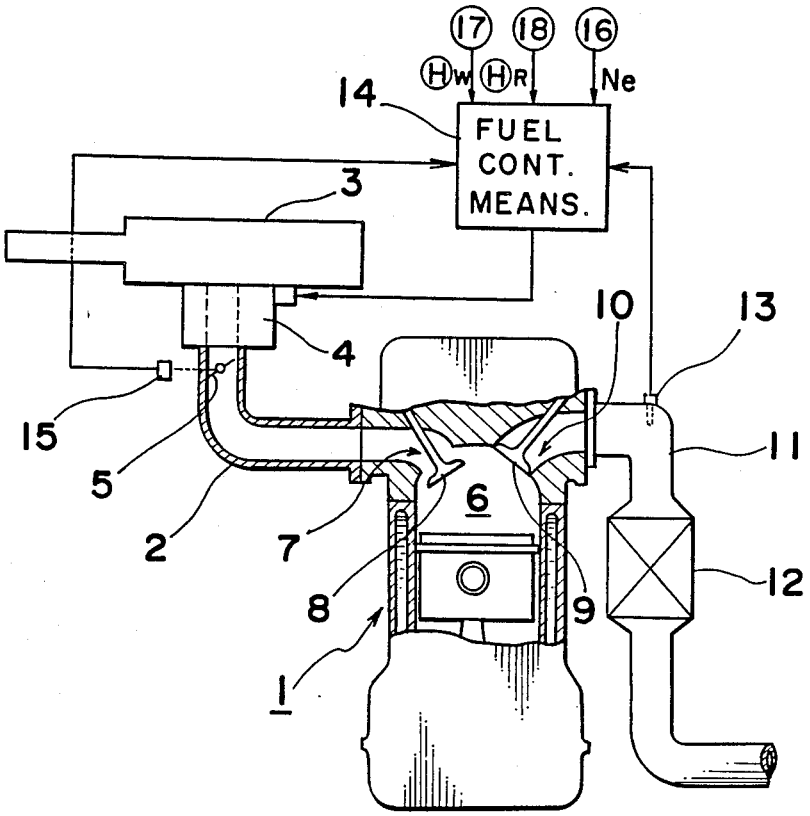
FIG. 2 is a schematic diagram showing a fuel supply control arrangement according to one preferred preferred embodiment of the present invention.

Referring now to the drawings, there is shown in FIG. 2 an internal combustion engine 1 to which a fuel supply control arrangement according to one preferred embodiment of the present invention is applied.

As illustrated in FIG. 2, in an intake passage 2 of the engine 1, there are sequentially provided from the upstream side, an air cleaner 3, a carburetor 4 and a throttle valve 5, and an intake port 7 open into a combustion chamber 6 is adapted to be opened or closed at a predetermined timing by an intake valve 8.

Meanwhile, in an exhaust passage 11 connected to an exhaust port 10 arranged to be opened or closed with respect to the combustion chamber 6 by an exhaust valve 9, there is provided in its course, an exhaust gas purification device 12 of a catalytic type, with an $O_2$ sensor 13 being disposed at the upstream side thereof for detecting an air/fuel ratio of an air/fuel mixture.

Although not specifically shown, the carburetor 4 is arranged to control the fuel supply amount, for example, through control of an air bleeding amount as is well known, and for the purpose, a fuel control circuit 14 constituted by a micro-computer is provided.

To the fuel control circuit 14 referred to above, a throttle opening degree to be detected by an opening degree sensor 15 provided with respect to the throttle valve 5, a rich or lean state of the air/fuel mixture to be detected by the $O_2$ sensor 13, engine revolutions Ne to be detected by a revolution sensor 16, an engine cooling water temperature Ⓗ W detected by a first water temperature sensor 17, and a radiator water temperature Ⓗ R proportional to the intake gas temperature, to be detected by a second water temperature sensor 18, etc. are inputted as control information. It is to be noted here that, instead of detecting the radiator water temperature Ⓗ R, the temperature of the intake gas may be adapted to be directly detected through employment of a temperature sensor.

Figure 3:
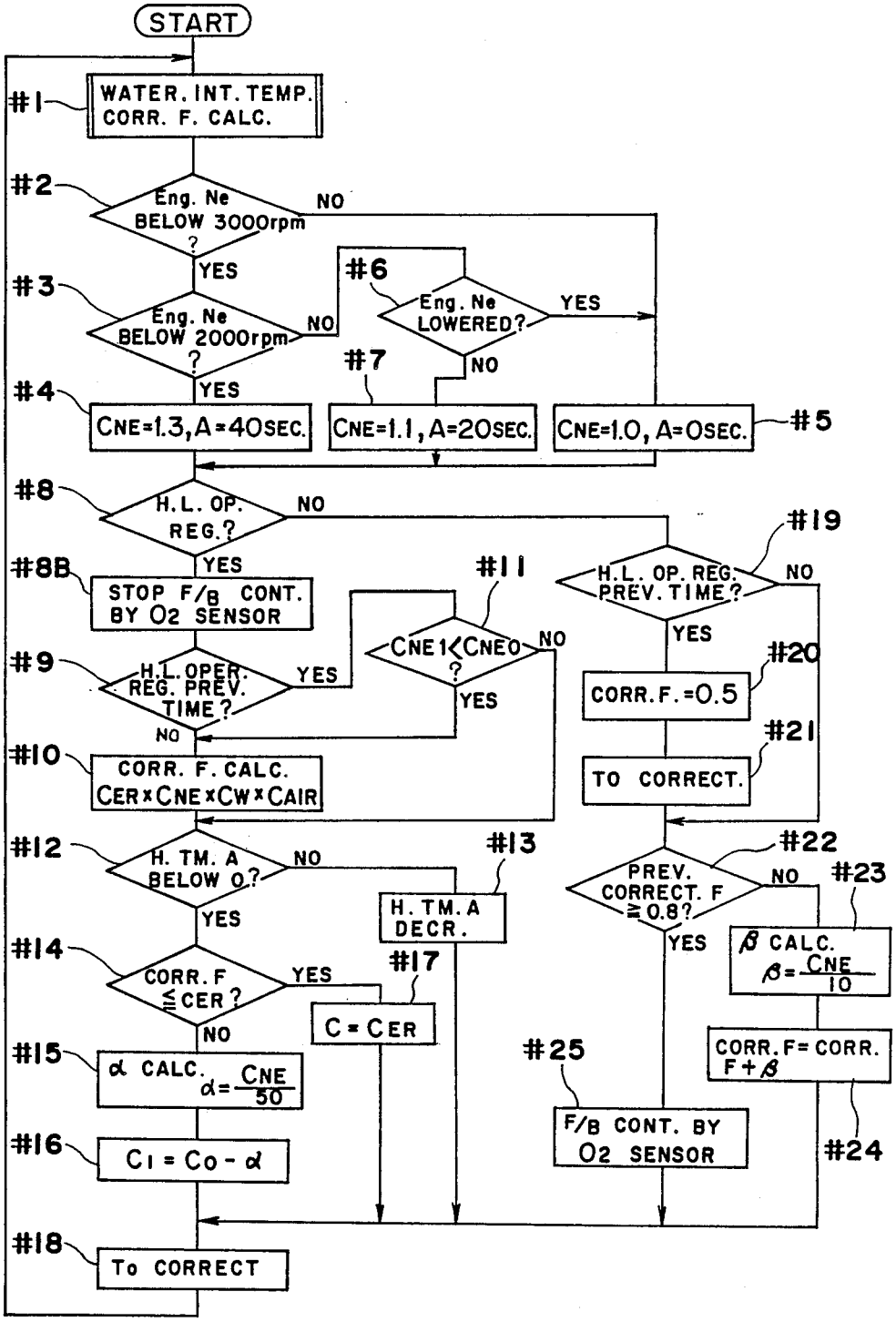
FIG. 3 is a flow-chart of a fuel control program to be executed in the above embodiment of the present invention.

The above fuel control circuit 14 executes the fuel control program according to a flow-chart shown in FIG. 3.

Figure 4:
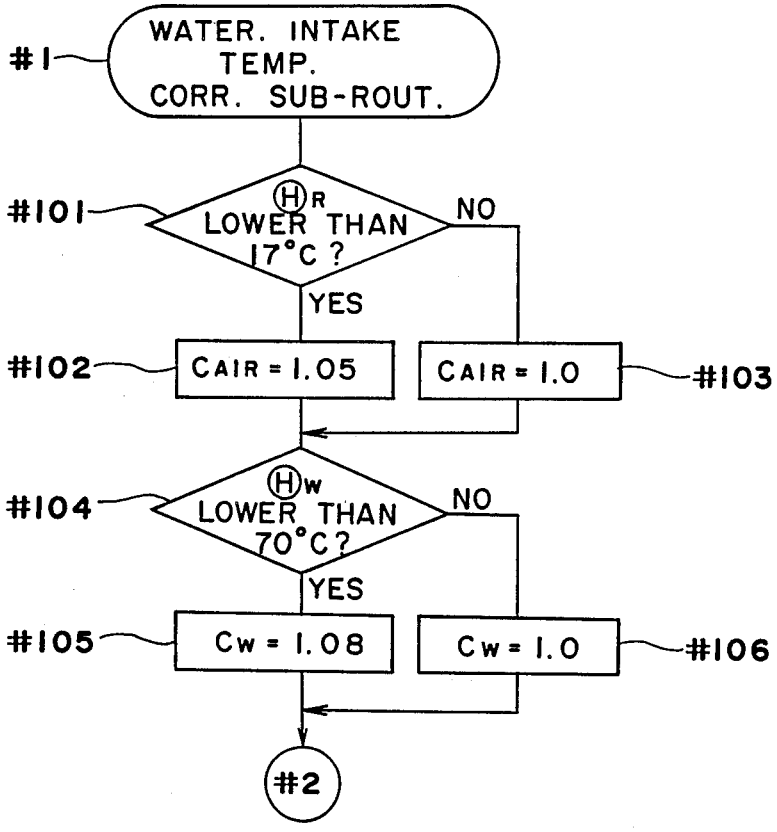
FIG. 4 is a flow-chart showing a subroutine for the correction of water temperature and intake gas temperature.

Now, in FIG. 3, upon starting of the above control, the intake gas temperature and water temperature correction factors are first calculated at step #1. This step #1 is constituted as a sub-routine, and the contents thereof are shown in FIG. 4. More specifically, in FIG. 4, judgement is made at step #101 as to whether or not the radiator water temperature Ⓗ R as detected by the second water temperature sensor 18 is lower than 17° C., and if it is of "YES", the intake gas temperature correction factor $C_{AIR}$ is set at $C_{AIR}=1.05$ at step #102. In the case where the radiator water temperature Ⓗ R is higher than 17° C., it is not necessary to correct the intake gas temperature, and therefore, the intake gas temperature correction factor $C_{AIR}$ is set at $C_{AIR}=1.0$ (step #103).

Subsequently, at step #104, it is checked whether or not the engine cooling water temperature Ⓗ W as detected by the first water temperature sensor 17 is lower than 70° C., and in the case of the cold engine below 70° C., the water temperature correction factor $C_W$ is set, for example, at $C_W=1.08$ at step #105. Since correction of the water temperature is not required when the temperature is above 70° C., the water temperature correction factor $C_W$ is set at $C_W=1.0$ at step #106.

Referring back to FIG. 3, at step #2, it is judged whether or not the engine revolutions Ne (Eng. Ne) are smaller than 3,000 rpm, and if the revolutions are below 3,000 rpm, judgement is further made, at step #3, as to whether or not the revolutions are lower than 2,000 rpm.

If the engine revolutions are below 2,000 rpm, a transient revolution correction factor $C_{NE}$ is set to 1.3 at step #4, and simultaneously, a hold time A of a hold timer (to be defined on the program) which provides the time to maintain the value, is set at 40 seconds.

On the other hand, in the case where the engine revolutions Ne are above 3,000 rpm, correction of the revolutions is not effected, and accordingly, at step #5, the correction factor $C_{NE}$ is set at $C_{NE}=1.0$, and the hold time A is set at A=0 second. Meanwhile, when the engine revolutions Ne are equal to or lower than 3,000 rpm, but higher than 2,000 rpm (i.e., $2{,}000<Ne\leqq 3{,}000$ rpm), it is checked at step #6 whether or not the engine revolutions Ne are lowered as compared with the previous value, and if the result of the checking is of "YES", the procedure reverts to step #5 without effecting the revolution correction ($C_{NE}=1.0$).

Conversely, when the engine revolutions Ne are raised, the transient revolution correction factor $C_{NE}$ is set to $C_{NE}=1.1$, and the hold time A is set to A=20 seconds respectively at step #7. As is clear from the comparison with the setting at step #4, the revolution correction factor is set to be lower than that in the case of the revolutions lower than 2,000 rpm.

The transient revolution correction factor $C_{NE}$ as described above is intended to set an additional amount of fuel with respect to a high load fuel increasing amount factor $C_{ER}$ to be described hereinbelow. As is seen from the foregoing description, the transient revolution correction factor $C_{NE}$ is divided into three stages according to the engine revolutions Ne during the transfer into the high load operating region, with the factor value being set smaller as the engine revolutions Ne become higher. Such setting is adopted by taking into consideration the fact that, the smaller the intake air amount is, the more fuel adheres to the intake passage wall surface, and in the case where the intake air amount is increased following the increase of the number of engine revolutions, the fuel adhering amount is to be decreased.

After the revolution correction as described above, at step #8 judgement is made, based on the throttle opening degree, as to whether or not the present state of operation is in the high load operating region, and if the operation is found to be in the high load operating region, the feed-back control by the $O_2$ sensor is stopped at step #8B, and thereafter, at next step #9, it is checked whether or not the previous operation was in the high load operating region. If the previous operation was not in the high load operating region and the transfer to the high load operating region is first effected this time, the high load fuel increasing amount factor $C_{ER}$ is set at step #10, and an overall correction factor C is calculated based on the transient revolution correction factor $C_{NE}$, water temperature correctionfactor $C_W$, and intake gas temperature correction factor $C_{AIR}$, which have been already obtained through calculation ($C=C_{ER}\cdot C_{NE}\cdot C_W\cdot C_{AIR}$).

At step #9, if it is judged that the operation was in the high load operating region in the previous time also, the previous transient revolution correction factor $C_{NE0}$ is compared with the present transient revolution correction factor $C_{NE1}$ in values at step #11, and if the value for the present factor $C_{NE1}$ is smaller, the procedure returns to step #10, and the correction factor calculation similar to that as described above is effected.

On the other hand, in the case where the value of the present correction factor $C_{NE1}$ is equal to or larger than the value of the previous correction factor $C_{NE0}$ (i.e., $C_{NE1} \geqq C_{NE0}$), the procedure proceeds to step #12, with the correction factor calculation in step #10 skipped. In other words, it is not required to newly calculate the correction factor C in the above case.

At step #12 referred to above, in both cases where the calculation of the correction factor C is effected (step #10) and where such calculation is not effected (step #11), judgement is made as to whether or not the hold timer A is less than "0" (i.e., whether or not the hold timer A has reached "time-up"), and if it has not reached "time-up", the hold timer A is subjected to decrement at step #13.

In the case where the hold timer A has already completed "time-up", the present correction factor C is compared with the high load increasing amount factor $C_{ER}$ at step #14, and if the factor C is equal to or smaller than the factor $C_{ER}$, an attenuation factor $\alpha$ with respect to the correction factor C is calculated at step #15. The attenuation factor is set, for example, at $\alpha=C_{Ne}/50$, and at step #16, the value equivalent to the attenuation factor $\alpha$ is subtracted from the previous correction factor $C_0$ so as to obtain the present correction factor $C_1$.

Meanwhile, if the correction factor is smaller than the high load increasing amount factor $C_{ER}$, the present correction factor C is set to the high load increasing amount factor $C_{ER}$ itself at step #17.

In the manner as described above, the fuel control at the time of transfer into the high load operating region as the specific operating region, and the fuel control also in the subsequent high load operating region are to be executed.

Figure 5A:
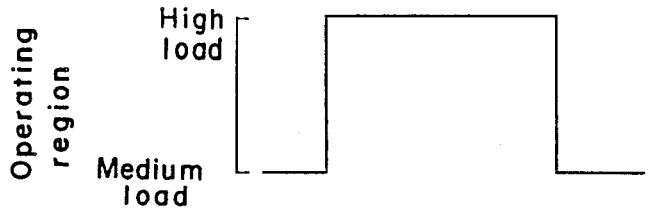
FIGS. 5(A), 5(B), 5(C) and 5(D) are time-charts respectively showing variations of the operating region, correction factor, air/fuel ratio in an intake passage, and air-fuel ratio in a combustion chamber.
Figure 5B:
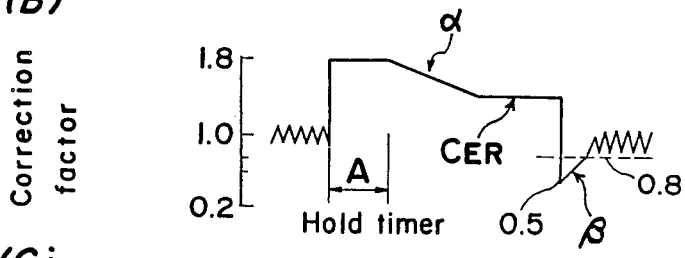

In the above fuel control, as shown in FIG. 5(A), upon transfer into the high load operating region, the amount represented by the transient revolution correction factor $C_{NE}$ whose value is determined according to the engine revolutions at that time is introduced, and as illustrated in FIG. 5(B), immediately after transfer, a high increasing rate in which the value equivalent to the transient revolution correction factor $C_{NE}$ is further added to the normal increasing rate in the high load operation region, i.e., to the high load increasing amount factor $C_{ER}$, is set so as to supply the fuel on the increased side at that increasing rate by taking into account the amount of fuel adhering to the intake passage 2, during the set time of the hold timer A. Thus, after the time-up of the hold timer A, the correction factor C is gradually lowered by the attenuation rate $\alpha$, so as to be finally maintained at the inherent high load increasing amount factor $C_{ER}$ for continuing the fuel control in the subsequent high load operating region.

Figure 5C:
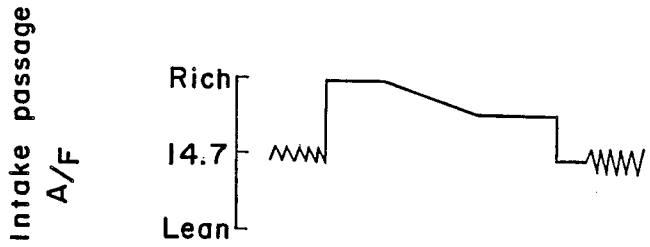
Figure 5D:
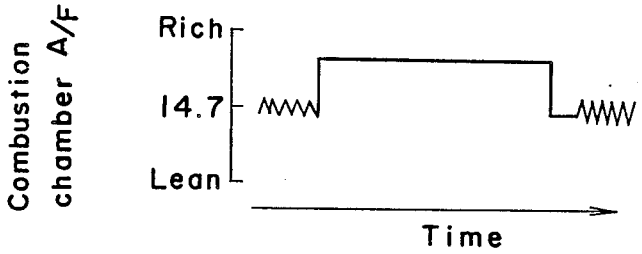

As a result, as shown in FIG. 5(C), the air/fuel ratio A/F in the intake passage 2 shows variation similar to that of the above correction factor, but as represented in FIG. 5(D), the air/fuel ratio A/F in the combustion chamber 6 is to be maintained at the desired rich state from the time point immediately after the transfer.

Subsequently, the fuel control upon transfer from the high load operating region to the low load operating region, and also the fuel control in the low load operating region will be described hereinbelow.

Referring back to FIG. 3, at step #8, in the case where judgement is so made that the operation is not in the high load operating region, it is first checked at step #19 whether or not the operation was in the high load operating region in the previous time.

If the operation was in the high load operating region at the last time, i.e., it is first transferred from the high load operating region to the low load operating region this time, the correction factor C is set to 0.5 at step #20 (FIGS. 5(A), 5(B)). This is based on the concept contrary to that in the case where the operation is transferred from the low load operating region to the high load operating region. More specifically, due to the continuous high load operation, the adhering of fuel in the intake passage 2 is stabilized on the increased side, and immediately after the transfer into the low load operation, the adhering fuel is temporarily withdrawn from the intake passage 2 into the combustion chamber 6 as the intake negative pressure rises, and therefore, setting is so made that the correction factor is lowered to a large extent by taking the above amount into account. Thus, the first correction is effected by this correction factor $C=0.5$ (step #21).

In the case where the operation was not in the high load operating region at the previous time, the procedure proceeds from step #19 to step #20, and then, to step #22 by skipping step #21. At step #22, it is checked whether or not the previous correction factor $C_0$ is equal to or larger than 0.8, and if the factor is smaller than 0.8, an increasing rate $\beta$ is calculated (step #23). This increasing rate is given, e.g. as $\beta = C_{NE}/10$. At step #24, the present correction factor $C_1$ is given by adding the increasing rate $\beta$ to the previous correction factor $C_0$ ($C_1 = C_0 + \beta$).

Meanwhile, when the correction factor C exceeds 0.8, the control returns to a so-called feed-back control based on the rich/lean signal by the $O_2$ sensor 13 (step #25) and thus, the fuel control based on the rich or lean state of the air/fuel ratio is to be started. (FIG. 5(B)).

As is seen from the foregoing description, during transfer from the high load operation to the low load operation, the fuel control is so effected that the fuel is once reduced to a large extent by taking into account the amount of fuel adhering onto the intake passage wall surface, and thereafter, gradually increased for smooth transfer finally into the control by the $O_2$ feed-back.

By the above practice, as shown in FIG. 5(C) and FIG. 5(D), the enriching of the air/fuel mixture during the transfer from the high load operation to the low load operation can be positively prevented, and thus, the air/fuel ratio A/F of the air/fuel mixture may be accurately controlled to the specific air/fuel ratio (e.g., theoretical air/fuel ratio) from the time point immediately after the transfer.

It should be noted here that, in the foregoing embodiment, although a carburetor is employed as a fuel supply means, such carburetor may of course be replaced by a fuel injection valve or the like.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. In an internal combustion engine provided with a fuel supply means for supplying fuel into an intake passage of said engine, a fuel supply control arrangement which comprises:

a specific operating region detecting means for detecting a specific operating region in which an air/fuel ration of an air/fuel mixture should be decreased as compared with that in another operating region, a fuel amount correcting means for correcting an amount of fuel to be supplied by said fuel supply means, and a correction factor setting means for setting a correction factor for the fuel, said correction factor setting means being so arranged as to set the correction factor in such a manner that, at an initial stage when the transfer from the specific operating region to the other operating region, or from the other operating region to the specific operating region is detected by said specific operating region detecting means, the correction factor is set so as to correct the fuel amount fed into the intake passage more excessively than in a fuel amount which provides the air/fuel ratio in the operating region at said initial stage after the transfer, and thereafter, to cause the fuel amount to be restored to that which provides the air/fuel ratio at said operation regions whereby an air fuel ratio at said intake passage is different during said initial stage than during said operating region while said air/fuel ratio in a combustion chamber of said combustion engine is substantially uniform during said initial stage and throughout said operating region.

2. A fuel supply control arrangement as claimed in claim 1, wherein said correction factor which corrects the fuel amount more excessively is maintained for a predetermined period of time from the time point when the transfer to the operating region is effected.

3. A fuel supply control arrangement as claimed in claim 1, wherein said correction factor for correcting the fuel amount more excessively is adapted to be gradually attenuated at the operating region after the transfer so as to be gradually restored to a normal fuel amount.

4. A fuel supply control arrangement as claimed in claim 1, wherein said correction factor for correcting the fuel amount more excessively is arranged to be altered depending on operating conditions of the engine.

5. A fuel supply control arrangement as claimed in claim 4, wherein said correction factor is larger as intake gas temperature becomes lower.

6. A fuel supply control arrangement as claimed in claim 4, wherein said correction factor is larger as water temperature of the engine becomes lower.

7. A fuel supply control arrangement as claimed in claim 4, wherein said correction factor is larger as intake gas flow rate becomes lower.

8. A fuel supply control arrangement as claimed in claim 7, wherein the specific operating region is a high-load operating region, with judgement that the larger the number of engine revolutions, the higher the intake gas flow rate.

9. A fuel supply control arrangement as claimed in claim 7, wherein the correction factor is maintained for a predetermined period of time from the point of transfer into the operating region, with said predetermined period of time being prolonged as the intake gas flow rate becomes low.

10. A fuel supply control arrangement as claimed in claim 7, wherein the correction factor has a larger correction value as the intake gas flow rate becomes lower.

11. In an internal combustion engine provided with a fuel supply means for supplying fuel into an intake passage of said engine, a fuel supply control arrangement which comprises:

a specific operating region detecting means detecting means for detecting a specific operation region in which an air/fuel ratio of an air/fuel mixture should be decreased as compared with that in another operating region, a fuel amount correcting means for correcting an amount of fuel to be supplied by said fuel supply means, and a correction factor setting means for setting a correction factor for the fuel, said correction factor setting means being so arranged as to effect the setting in such a manner that, at an initial stage when the transfer to the specific operating region is detected by said specific operating region detecting means, a fuel increasing rate which is fed to the intake passage is set to be higher than that which provides an air/fuel ratio at the specific operation region, and thereafter, to be restored to an original fuel increasing rate which provides said air/fuel ratio whereby, an air/fuel ratio in said intake passage is different during said initial stage than during said operating region while said air/fuel ratio in a combustion chamber of said combustion engine is substantially uniform during said initial stage and throughout said operating region.

12. In an internal combustion engine provided with a fuel supply means for supplying fuel into an intake passage of said engine, a fuel supply control arrangement which comprises:

a specific operating region detecting means for detecting a specific operating region in which an air/fuel ratio of an air/fuel mixture should be decreased as compared with that in another operating region, a fuel amount correcting means for correcting an amount of fuel to be supplied by said fuel supply means, and a correction factor setting means for setting a correction factor for the fuel, said correction factor setting means being so arranged as to set the correction factor in such a manner that, at an initial stage when the transfer from the specific operation region to the other operating region is detected by said specific operating region detecting means, the correction factor is set so as to correct the fuel amount which is fed to the intake passage to be smaller than a fuel amount which provides the air/fuel ratio set in said other operating region, and thereafter, to cause the fuel amount to be restored to that which provides said air/fuel ratio whereby an air/fuel ration in said intake passage is different during said initial stage than during said operating region while said air/fuel ratio in a combustion chamber of said combustion engine is substantially uniform during said initial stage and throughout said operating region.

13. In an internal combustion engine provided with a fuel supply means for supplying fuel into an intake passage of said engine, a fuel supply control arrangement which comprises:

a specific operating region detecting means for detecting a specific operating region in which an air/fuel ratio of an air/fuel mixture should be decreased as compared with that in another operation region, a fuel amount correcting means for correcting an amount of fuel to be supplied by said fuel supply means, and a correction factor setting means for setting a operating region correction factor with respect to a specific operating region and for setting a revolution correction factor; the operating region correction factor being set at a constant value and the revolution correction factor adapted to be varied, said correction factor setting means being so arranged as to set the operating region correction factor in such a manner that, at an initial stage when the transfer from the specific operating region to the other operating region, or from the other operating region to the specific operating region is detected by said specific operating region detecting means, the operating region correction factor is set so as to correct the fuel amount, and consequently the air/fuel ration in the intake passage, more excessively than in a fuel amount which provides the air/fuel ratio in the operating region after the transfer so that a desired air/fuel ratio in a combustion chamber of the combustion engine is achieved, and thereafter, to cause the fuel amount to be restored to that which provides said air/fuel ratio at said operating region.

14. A fuel supply control arrangement as set forth in claim 13 wherein said revolution correction factor is adapted to be varied according to the revolution of the engine.

15. A fuel supply control arrangement as set forth in claim 14 wherein the revolution correction factor is adapted to be set relatively larger when the engine revolution is relatively lower and is adapted to be set relatively smaller when the engine revolution is relatively higher.

16. A fuel supply control arrangement as set forth in claim 14, wherein the revolution corrector factor is effected for a relatively longer period of time when the engine revolution is relatively lower and is effected for a relatively shorter period of time when the engine revolution is relatively higher.

* * * * *